United States Patent [19]

Paulson

[11] Patent Number: 4,542,817

[45] Date of Patent: Sep. 24, 1985

[54] DEVICE FOR PREVENTING IMPROPER OPERATION OF A SLOT MACHINE

[76] Inventor: Robert C. Paulson, 1111 N. Lamb Blvd., Las Vegas, Nev. 89110

[21] Appl. No.: 553,515

[22] Filed: Nov. 21, 1983

[51] Int. Cl.[4] ..... G07F 3/02

[52] U.S. Cl. ..... 194/99; 194/1 K

[58] Field of Search ..... 194/1 K, 97 A, 97 B, 194/100 A, 102, 99, 10, 97 R

[56] References Cited

U.S. PATENT DOCUMENTS

| | | | |
|---|---|---|---|
| 3,241,645 | 3/1966 | Nielsen | 194/102 X |
| 4,298,116 | 11/1981 | Niemeyer | 194/97 R |
| 4,483,431 | 11/1984 | Pratt | 194/97 A |

*Primary Examiner*—Stanley H. Tollberg
*Attorney, Agent, or Firm*—Edward L. Benno

[57] ABSTRACT

A modified coin track assembly for known slot machines of the type which is generally operated by a person first inserting a coin of a certain value into the machine which causes the machine to be conditioned for a gaming operation, and by the person then initiating a gaming operation. The modified coin track assembly receives the inserted coin and checks the coin for certain predetermined parameters such as thickness, surface light reflectivity and an attached string, and prevents condition of the machine for a gaming operation if the coin does not have those predetermined parameters or has a string attached.

7 Claims, 5 Drawing Figures

DEVICE FOR PREVENTING IMPROPER OPERATION OF A SLOT MACHINE

BACKGROUND OF THE INVENTION

The subject invention concerns devices which may be added to existing slot machines to prevent the improper operation of such machines. Machines which are commonly called slot machines are gaming machines in which a person deposits a coin of a predetermined value such as a silver dollar into the coin slot of the machine. Generally, under the force of gravity the coin slot directs the coin into the entrance end of a coin track. The coin track is elongated horizontally with spaced apart upright side walls and a bottom wall which is slightly inclined downwardly from the entrance end to the exit end thereof. The coin rolls in an upright condition through the coin track and drops through the exit end thereof to strike an electrical switch which then conditions the machine for a subsequent gaming operation. In some instances such slot machines are intended to be operated by a facsimile of a coin of predetermined value within certain parameters. Generally those parameters are weight, diameter, thickness and a surface condition such as light reflectivity.

The improper operation of such slot machines generally involves a person using a slug to effect operation of the machine. Slugs are generally coin-like pieces which resemble the intended coin. They often differ from the intended coin or facsimile in one or more of the noted parameters. Some are thinner, or are dished or slightly concave as a slug sheared from a metal sheet by a punch press, or have a different surface light reflectivity from the parameter of the intended coin. Another improper operation of such slot machines can be effected by using an intended coin attached to a thin string. The string can be used to prevent the coin from dropping into a coin collection box after the electrical switch which conditions the machine for operation has been engaged by the coin. By slightly pulling on the string to draw the coin upwardly and then again allowing the coin to descent toward the electrical switch, the machine can be repeatedly conditioned for operation with the same coin.

Many devices are known in the prior art for testing or determining the various parameters of coins. Most of that art has developed with the growth of coin operated vending machines. In the vending machine art it is necessary or desireable that the machine detect and count coins of various denominations for the purposes of totaling the amount required for vending of a product and for returning any excess amounts. It is further important in the vending machine art that the machine not be disabled upon detecting a slug because vending machines are often placed at locations remote from readily available machine maintenance personnel. Therefore coin detection mechanisms for vending machines are designed to avoid any shut down of the machine, but to direct any coins detected as non-genuine to a coin reject slot while maintaining the operability of the machine. The known devices for coin detection of the vending machine art are not appropriate for the gaming machine art because gaming machines are generally designed for operation with a coin of one denomination and are placed at locations where maintenance personnel are readily available. In the gaming machine art it is desireable that the use of a slug or object other than that intended for operation of the machine result in a shut down of the machine with the initiation of some audible or visual alarm.

It is the primary object of the present invention to provide coin or slug detection devices for gaming machines which devices will operate to test or measure various selected parameters of a coin and which shut down or prevent operation of the machine upon determining that the deposited coin does not meet one of the selected parameters.

It is a further object to additionally provide in such devices a simple means for detecting a coin with an attached string and shutting down the machine in response thereto.

It is a further object to provide such devices in a relatively simple, economical form readily adaptable to existing gaming machines.

Other objects and features of the present invention will be apparent in the hereinafter following detailed description.

SUMMARY OF THE INVENTION

Devices made according to the invention comprise a modified coin track which may be simply substituted for the coin tracks of known gaming machines, and certain electrical circuitry enabling the coin detection components of the modified coin track to control the operation of those gaming machines. The known gaming machines for which the subject invention is intended have a coin insertion slot of a length and width approximating the diameter and thickness of the coin to be used in securing an operation of the machine. Within the machine and below the coin slot is a coin track comprising a pair of spaced apart upright side walls interconnected by a bottom wall therebetween. The deposited coin will drop in an upright position into the coin track at the entrance end thereof. The bottom wall is inclined slightly downwardly from the entrance end to the exit end thereof, and the coin will roll along the bottom wall and drop through an opening in the bottom wall of the coin track at the exit end thereof. The coin, in dropping from the exit end of the coin track will strike an electrical switch which in operating will condition the gaming machine for a further gaming operation. After striking that electrical switch the coin falls into a coin collection box or other coin receptor.

Briefly, against that background, the coin track of the subject invention is substituted for the described coin track, and also comprises a pair of spaced apart upright side walls interconnected by a bottom wall. A leaf spring which has a number of functions is secured at one end thereof within the coin track to extend longitudinally thereof. One function of the spring is to stabilize the rolling coin in a vertical plane. Another function is to direct the rolling coin over a slot in the bottom wall of the coin track. A further function is to provide a light reflective surface of certain predetermined characteristics.

The slot in the bottom wall over which the spring directs a coin has one side thereof contiguous to the side wall of the coin track opposite to that to which the spring is secured. The slot is of a width slightly less than the thickness of a proper coin. Thus a slug which is thinner than a proper coin will in being directed over the slot fall partially therethrough. The spring is curved along its longitudinal axis and the crown of the spring is adjusted to be substantially at the end of the slot toward the coin entrance end of the coin track. In reductions to practice with this arrangement it has been found that a dished slug is directed so that the rolling edge in contact with the bottom wall drops into the slot.

The side wall of the coin track which is contiguous to the above described slot, is provided with an open area therethrough and a unit commonly referred to as an L.E.D. is mounted on the side of the coin track over the open area. The L.E.D. is known in the electrical art as a light emitting diode and comprises a unitary assembly of a fixed light source and light receptor. In the present invention the light source and light receptor are arranged so that light from the light source strikes the facing surface of the spring through the open area in the side wall of the coin track and is reflected thereby back to the light receptor. The light reflective characteristics of the surface of the spring are provided to be substantially the same as those of a proper coin, and the circuitry associated with the L.E.D. is such that the gaming machine is maintained or permitted to remain in an operative condition as light from the light source strikes the surface of the spring and is reflected back to the light receptor. Thus as a proper coin rolls along the bottom wall of the coin track between the spring and open area of the side wall no change in the operative condition of the gaming machine occurs. However, if a coin or slug having light reflective characteristics substantially different from those of a proper coin rolls between the spring and the open area, the circuitry associated with the L.E.D. responds by placing the gaming machine in an inoperative condition. In reductions to practice of the invention it has been found that the stabilizing effect of the spring on a coin or slug rolling along the bottom wall of the coin track aids in effecting a proper response of the L.E.D. and its associated circuitry to the light reflected from the coin or slug.

As in the described coin track of known gaming machines, the bottom wall of the coin track of the subject invention terminates short of the exit end of the coin track to permit a coin to drop therethrough and condition the gaming machine for further operations. However, in the subject invention, the terminating end of the bottom wall is angled diagonally toward the exit end and the side wall opposite from that having the open area. Further, a string accepting slot is provided in the bottom wall with one side thereof contiguous to the side wall having the open area. The string accepting slot is open into the coin drop opening at the exit end of the coin track. That described construction of the bottom wall functions to direct and receive the string of a string and attached coin assembly when the coin of that assembly drips through the exit end of the coin track. The string accepting slot functions to prevent the coin of a string-attached coin from being drawn upwardly into the coin track and directs the string into engagement with a switch assembly.

The switch assembly is mounted to and beneath the coin track and has two functions. Its first function is to operate responsive to the dropping of a relatively thin slug into the slot in the bottom wall of the coin slot immediately after the crown of the previously described leaf spring to prevent further operation of the gaming machine. Its second function is to operate responsive to its engagement by the string of a string-attached coin to prevent further operation of the gaming machine.

Preferably, the circuitry for the described L.E.D. and the switch assembly are so connected that in addition to preventing further operation of the gaming machine an alarm, either visual or audio, is energized to indicate that the gaming machine has been shut down.

DETAILED DESCRIPTION OF THE INVENTION

Figure 1:
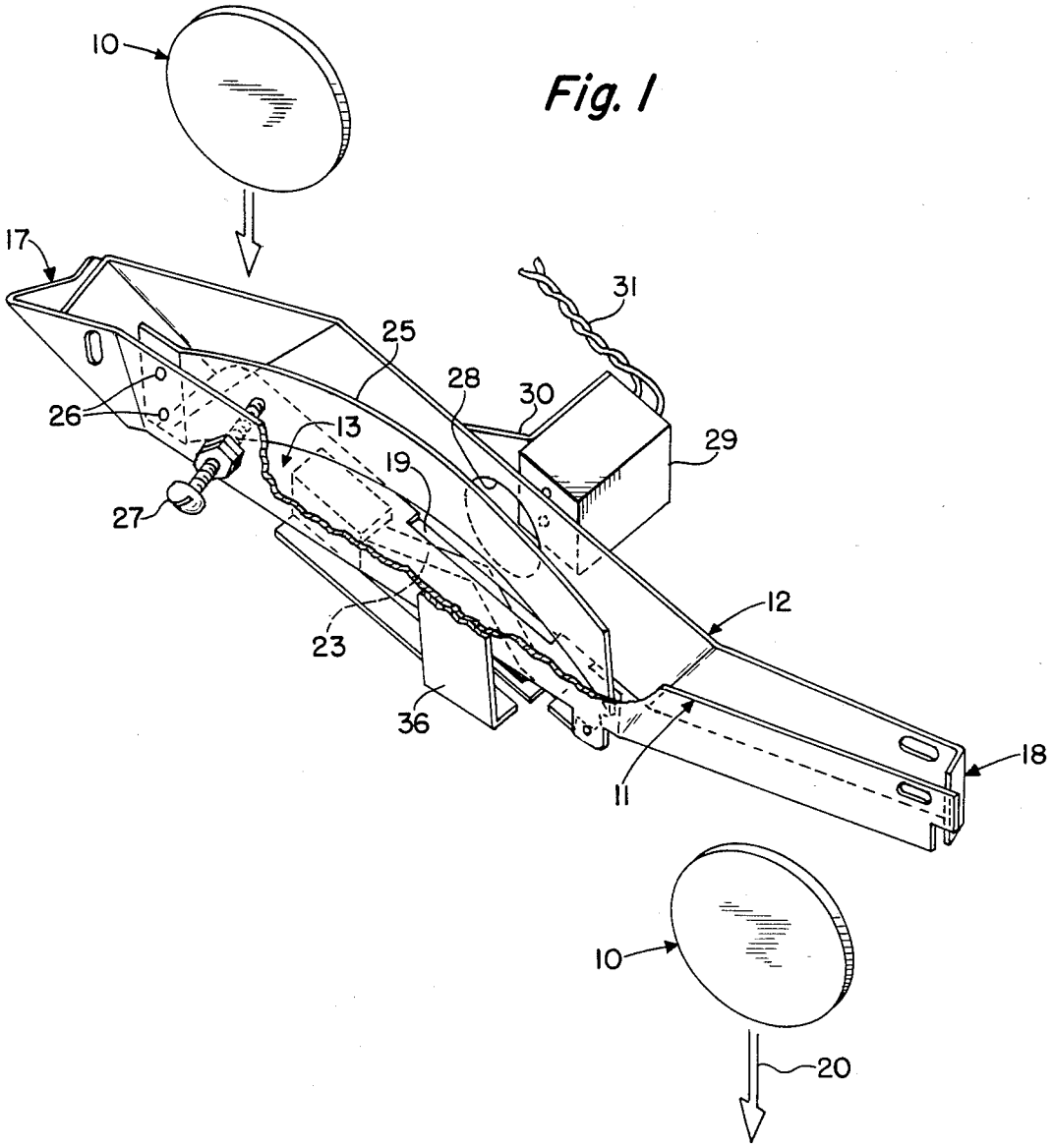
FIG. 1 is an isometric view of one embodiment of the invention.

FIG. 1 shows the preferred embodiment of the invention removed from a gaming machine for which the present invention is intended. It is believed that the description would be unnecessarily complicated by showing the invention installed in a gaming machine. With sufficient reference herein to the appropriate type of known gaming machines those skilled in this art will understand the invention. Such machines are generally operated by using a coin of a certain denomination such as a silver dollar or a facsimile thereof. In a front upper portion of the machine a coin slot is provided. A person inserts the coin in an upright position into the coin slot and releases it. A simple coin chute directs the falling coin into the entrance end of a coin track. The upper coin 10 shown in FIG. 1 is shown as representing a coin dropping through the coin chute toward the entrance end of the coin track. The lower coin 10 is shown as representing a coin dropping from the exit end of the coin track to engage a switch (not shown) which upon operation will condition the gaming machine for further operation. Such further operation in many known gaming machines may be the pulling of a lever to play the game for which the machine is designed.

In such known gaming machines the coin track is primarily a coin control and directing unit and simply comprises a pair of spaced apart upstanding side walls interconnected by a bottom wall. The bottom wall terminates short of exit end of the coin track to permit the deposited coin to fall therefrom. The coin track is secured in the machine with the bottom wall inclined slightly downwardly from the entrance end to the exit end of the coin track.

The coin track of the present invention comprises forward side wall 11 and rear side wall 12 interconnected along portions of their lower edges by bottom wall 13. In FIG. 1 a portion of side wall 11 has been removed to better show the other parts. The side walls 11 and 12 are slightly S-shaped longitudinally thereof as may be seen in FIGS. 1 and 3 for convenient mounting in known gaming machines. The coin track is mounted in a gaming machine by fasteners (not shown) extending through the openings 14, 15 and 16 in the side walls 11 and 12 to position the bottom wall 13 inclined slightly downwardly from the entrance end to the exit end of the coin track. At the entrance end of the coin track the ends of the side walls 11 and 12 are bent and overlapped to form the upwardly and outwardly inclined end wall 17. As may be seen in FIG. 3, the side walls 11 and 12 while substantially upright, are also inclined to slightly diverge in an upward direction. At the exit end of coin track the side wall 12 is bent toward side wall 11 to form end wall 18.

Figure 2:
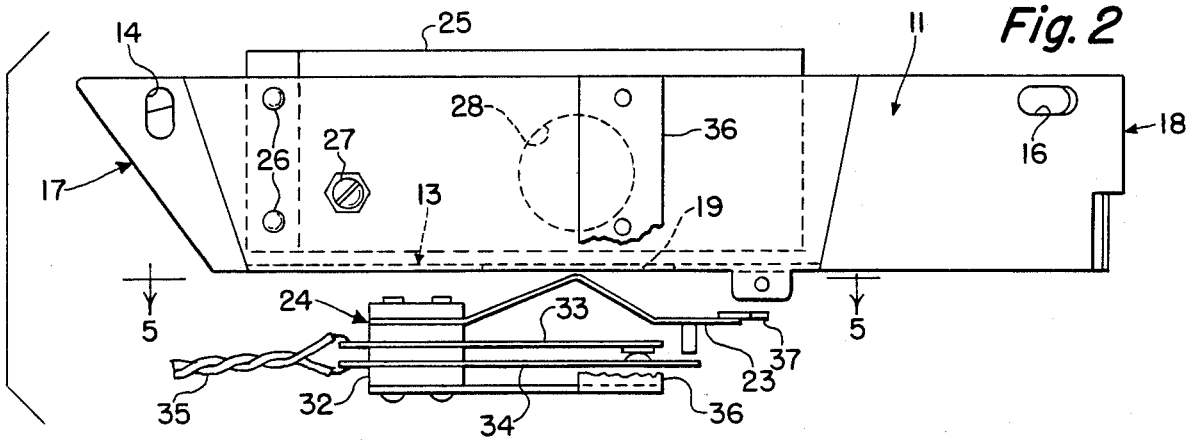
FIG. 2 is a side elevational view taken from the facing side shown in FIG. 1.
Figure 3:
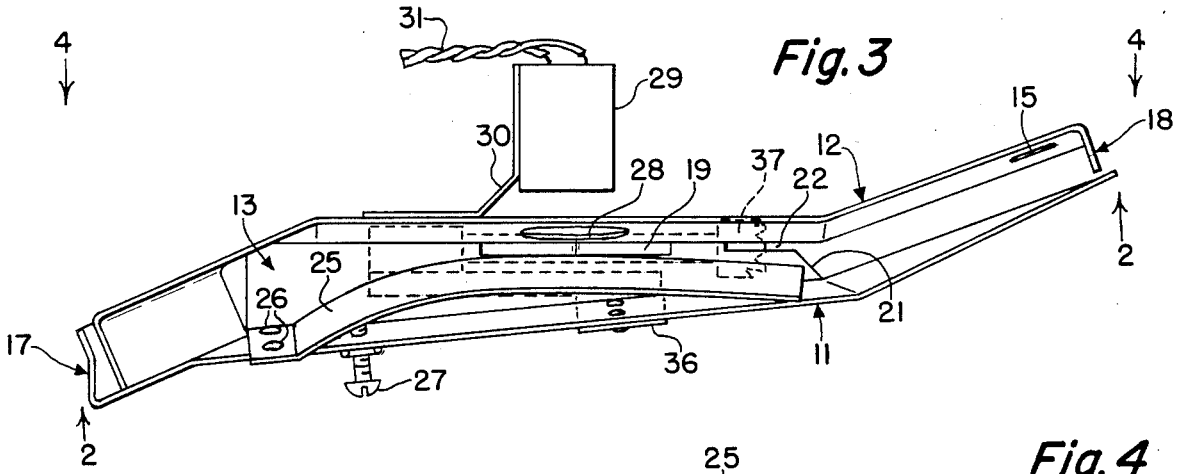
FIG. 3 is a top plan view of the structure of FIG. 2, and further shows that FIG. 2 is taken along the line 2—2 of FIG. 3.
Figure 4:
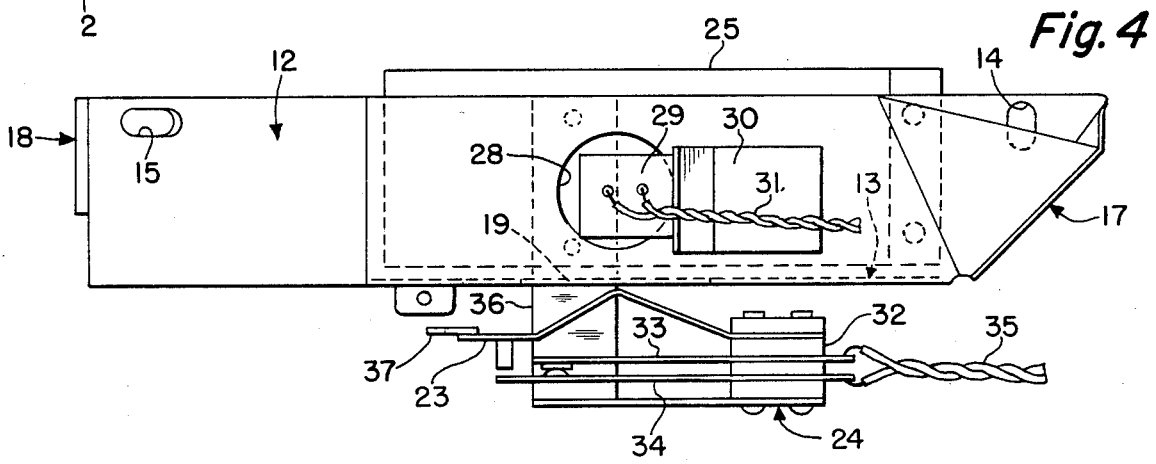
FIG. 4 is a side elevational view showing the other side of the structure and taken along the line 4—4 of FIG. 3.

The longitudinal extent of the bottom wall 13 is shown by the dotted lines in FIGS. 2 and 4 and in the top plan view of FIG. 3. Intermediate the ends of the bottom wall 13 and contiguous to the side wall 12 an elongated slot 19 is formed as may be seen in FIGS. 1 and 3. The slot 19 has a length less than the diameter of the coin intended to be used in the machine and a width slightly less than that coin. Thus a proper coin will not drop into slot 19, but will roll thereover. As may be seen in FIG. 3, the bottom wall 13 terminates short of the exit end of the coin slot leaving an open area between the side walls 11 and 12 sufficient for a coin to drop from the coin track as indicated by the lower coin 10 and the arrow 20 in FIG. 1. The end of the bottom wall 13 adjacent the exit end of the coin track is provided with an angled edge portion 21 and a string slot 22 as may be seen in FIG. 3. The angled edge portion 21 is angled from the string slot 22 toward the side wall 11 and the exit end of the coin track. The string slot 22 has a length sufficient to extend substantially over the armature 23 of the leaf switch assembly 24, and a width substantially less than the thickness of a coin intended to be used in the machine but greater than the larger gauges of common sewing threads.

The preferred embodiment of the invention further comprises a leaf spring 25. The spring 25 is formed of a relatively thin metal and preferably with a low stiffness such that a coin rolling between the spring and the coin track side wall can deflect the spring without stopping in its rolling action, but with sufficient stiffness to urge a rolling coin into a substantially upright straight rolling action. One end of the spring is secured to the inner surface of the side wall 11 in the entrance end of the coin track by suitable fasteners 26. The spring 25 is formed to be curved along its longitudinal axis and the crown of the spring 25 is positioned at the end of the slot 19 toward the entrance end of the coin track. A set screw 27 is threaded through the side wall 11 to engage the spring 25 adjacent its secured end. The set screw 27 provides for accurate placement of the extending portion of the spring 25 relative to the side wall 12 to stabilize and direct a coin in a straight rolling action along the side wall 12 and toward the exit end of the coin track.

Between the crown of the spring 25 and the extending end thereof in an area where a rolling coin will be most stable the side wall 12 is provided with an opening 28. The surface of the spring 25 opposite the opening 28 is provided with light reflective characteristics which are substantially that of the coin intended to be used in the machine.

A light emitting diode assembly 29 or L.E.D. as it is known in the elctrical art is mounted by means of a bracket 30 on the exterior surface of the side wall 12 and over the opening 28. Such L.E.D.'s are known to comprise a light source and a light receptor which are fixed in one face of the L.E.D. and aligned so that if a reflective surface is placed before that one face within a predetermined spacing range, the light receptor will receive reflected light from the light source. In the preferred embodiment the L.E.D. 29 is positioned so that its light receptor will receive light from its light source that is reflected through the opening 28 from the surface of the spring 25 or from a coin rolling on the bottom wall 13 past the opening 28. A cable 31 delivers power to the light source and passes the signal from the light receptor to an L.E.D. control unit (not shown). Such control units include electric switches which will operate or restore dependent upon the amount of light received by the light receptor. It is believed sufficient for the purpose of the subject invention to describe the L.E.D. control unit as connected to the gaming machine to maintain the gaming machine in an operative condition when the light receptor of the L.E.D. receives reflected light from the surface of the spring 25 or from a proper coin rolling past the opening 28 but to shut down the gaming machine when the light receptor of the L.E.D. receives a substantially different level or amount of reflected light as from a dull surfaced slug rolling past the opening 28.

The leaf switch assembly 24 is provided to shut down the gaming machine if a slug thinner than the thickness of a proper coin drops partially through the slot 19 or if the string of a string-attached coin enters the slot 22. The switch assembly 24 comprises an insulator block 32 which carries an armature 23 and normally closed contacts 33 and 34. The contacts 33 and 34 are connected to a cable 35. The cable 35 is connected by means (not shown) to the gaming machine to maintain the gaming machine in an operative condition when the contacts 33 and 34 are closed and to shut down the machine if the contacts 33 and 34 are momentarily opened. A bracket 36 secured to the underside of the insulator block 32 and to the side wall 11 secures the switch assembly to the coin track and beneath the bottom wall 13. Parts of the bracket 36 are shown broken away in FIGS. 1 and 2.

The armature 23 of the switch assembly 24 is positioned below the slot 19, and in the embodiment shown the longitudinally central portion of the armature 23 is bent upwardly with the apex of the bend immediately below and longitudinally centrally of the slot 19. That bend insures that a thin slug entering the slot 19 will immediately engage the armature 23 and move its extending end downwardly sufficiently to cause the armature 23 to engage with contact 34 and break its contact with switch contact 33. It is contemplated that the armature 23 may also be formed as a straight member. However, when the armature 23 is formed as a straight member, the bracket 36 must be made to position the armature sufficiently close to the underside of the bottom wall 13 to insure engagement and movement of the armature downwardly, by a thin slug dropping partially through slot 19, sufficiently to cause the armature 23 to open contacts 33 and 34.

Figure 5:
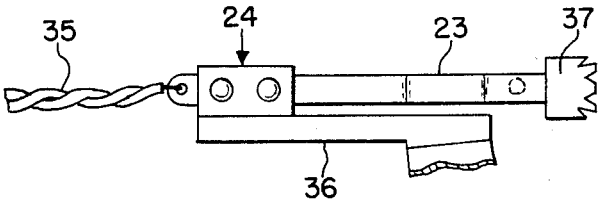
FIG. 5 is a cross sectional view of a portion of the structure shown in FIG. 2 and taken along the line 5—5 of FIG. 2.

In the preferred embodiment of the invention, the extending end of the armature 23 is provided with a string capturing pad 37 particularly shown in FIG. 5. The pad 37 is positioned immediately below slot 22 as may be seen in FIG. 3. The extending edge of the pad 37 is provided with serrations to capture the string of a string-attached coin and to avoid any sidewise sliding movement of the string from the pad 37 as tension on the string causes the armature 23 to move downwardly and open contacts 33 and 34. Tension on the string is the result of the weight of the attached coin at one end thereof and the holding of the other end thereof by a person grasping the string issuing from the coin deposit slot of the gaming machine.

It is believed that the operation of the subject invention is apparent to one skilled in this art from the above description and any other further description of the operation need only be brief. A proper coin such as coin 10 of FIG. 1 will drop into the entrance end of the coin track, will roll along the bottom wall 13 over the slot 19 past the opening 28, and will drop from the exit end of the coin track to condition the gaming machine for further operations. The switch assembly 24 will not be operated and the L.E.D. unit will not register any change in light reflectively. If a slug thinner than the proper coin is deposited in the coin slot of the gaming machine, it will in being directed by the spring 25 over the slot 19, drop partially therethrough and engage the switch assembly 24 which will operate to shut down the machine. Maintenance personnel may then open the machine, remove the slug, and reset the gaming machine for further proper coin initiated operations. Even if a thin slug is used which is concave to have an overall thickness of a proper coin, the spring 25 will direct the lower edge of the concave slug into the slot 19. If a slug of substantially different light reflectivity of that of a proper coin is deposited in the gaming machine, the L.E.D. unit will detect the difference in light reflectivity between the surface of the spring 25 and the slug and will cause the machine to shut down. If a string-attached coin is inserted in the coin slot of the gaming machine with a person holding the free end of the string, and if the coin succeeds in rolling through the coin track and dropping from the exit end of the coin track, any tension on the string will cause the string to slide along the edge 21 toward and into slot 22, and the string will then engage pad 37 of the switch assembly 24 and the switch assembly will be operated to shut down the machine.

Having described the invention it is to be understood that changes can be made in the described embodiments by one skilled in the art within the spirit and scope of the claims.

I claim:

1. In a slot machine having a coin slot which is intended to receive a coin or a facimile thereof of certain parameters and having a coin track of a bottom wall and spaced apart side walls arranged in said machine to receive said coin in the entrance end thereof when dropped from said coin slot and to direct said coin along said bottom wall in an upright rolling attitude between said side walls to drop from the exit end thereof and against a switch which then operates to condition said machine for a subsequent gaming operation, an improved coin track assembly for said machine mountable in substitution of said described coin track, said assembly comprising a first means for detecting an imitation of said coin which differs substantially in the parameter of thickness and for preventing said conditioning of said machine for a subsequent gaming operation in response to detecting said imitation, and a second means for detecting an imitation of said coin which differs substantially in the parameter of surface light reflectivity and for preventing said conditioning of said machine for a subsequent gaming operation in response to detecting said imitation, said first and second means comprising an elongated leaf spring member secured at one end thereof to one of the side walls of said assembly adjacent the entrance end thereof and extending longitudinally of said assembly between the side walls thereof toward the exit end thereof, said first means further comprising a slot formed in the bottom wall of said assembly intermediate the ends thereof and extending longitudinally of and contiguous to the other side wall of said assembly, said slot having a width less than the thickness parameter of a coin intended for said machine, and said leaf spring being curved longitudinally thereof with the convex side thereof facing said other side wall to guide a coin received in the entrance end of said assembly over said slot, whereby an imitation of said coin with a thickness parameter less than the thickness parameter of a coin intended for said machine is guided by said leaf spring to at least partially enter said slot.

2. In a slot machine as defined in claim 1, and said leaf spring being further formed and positioned with the crown thereof immediately adjacent the end of said slot toward the entrance end of said assembly, whereby the bottom rolling edge of a concave imitation of said coin is directed over said slot.

3. In a slot machine as defined in claim 1, and said first means further comprising a switch mounted on said assembly and positioned beneath said slot, said switch having an armature positioned relative to said slot to be engaged by an imitation of said coin at least partially entering said slot to operate said switch.

4. In a slot machine as defined in claim 1, said second means further comprising a surface area on said spring of a light reflectivity substantially the same as that of a coin intended for said machine, said surface area on said spring disposed on the face of said spring toward said other side wall of said assembly, and said other side wall of said assembly having an opening therethrough opposite of said surface area, and said second means further comprising means mounted on said assembly over said opening for detecting a substantial difference in light reflectivity from that of said surface area and for preventing said conditioning of said machine for a subsequent gaming operation in response to detecting said substantial difference.

5. In a slot machine as defined in claim 4, and said last mentioned means comprising a light emitting diode unit having a light source and a light receptor mounted in said unit so that light from said light source is reflected from said surface area and in the alternative from a coin disposed over said surface area to said light receptor, and said second means further including circuit means connected to said light emitting diode unit to prevent said conditioning of said machine for a subsequent gaming operation in response to said light receptor receiving reflected light from a coin substantially different from that from said surface area.

6. In a slot machine having a coin slot which is intended to receive a coin or a facimile thereof of certain parameters and having a coin track of a bottom wall and spaced apart side walls arranged in said machine to receive said coin in the entrance end thereof when dropped from said coin slot and to direct said coin along said bottom wall in an upright rolling attitude between said side walls to drop from the exit end thereof and against a switch which then operates to condition said machine for a subsequent gaming operation, an improved coin track assembly for said machine mountable in substitution of said described coin track and having substantially identical side and bottom walls, a slot in the end of the bottom wall of said assembly toward the exit end of said assembly, said slot being open into the exit end of said assembly and having one side thereof contiguous to one of the side walls of said assembly with the edge of the bottom wall of the assembly on the other side of said slot being angled from said slot toward the other of the side walls and the exit end of said assembly, whereby any tension on the trailing string of a coin with a trailing string attached wherein the coin has dropped from the exit end of said assembly will cause said string to enter said slot, said slot having a width less than the thickness parameter of a coin intended for said machine, an elongated leaf spring member secured in said assembly in a substantially upright position between the side walls thereof and longitudinally thereof from the entrance end to the exit end thereof, said leaf spring curved in a longitudinal direction and positioned to direct a coin dropped from said coin slot into said entrance end of said assembly longitudinally of said assembly and over said slot in the end of said bottom wall, a switch mounted on said assembly, said switch having an armature positioned beneath said slot to be engaged by said string when said string is tensioned and in said slot to operate said switch.

7. In a slot machine having a coin slot which is intended to receive a coin or facimile thereof of certain parameters and having a coin track of a bottom wall and spaced apart side walls arranged in said machine to receive said coin in the entrance end thereof when dropped from said coin slot and to direct said coin along said bottom wall in an upright rolling attitude to drop from the exit end thereof and against a switch which then operates to condition said machine for a subsequent gaming operation, the method for detecting an imitation of said coin which differs substantially in the parameters of thickness or surface light reflectivity and for preventing said conditioning of said machine for a subsequent gaming operation in response to detecting said imitation comprising the steps of:

making said coin track to provide a surface within said coin track between the side walls thereof guiding a coin received in the entrance end thereof substantially against and along one side wall of said coin track, detecting through said one side wall a light reflectivity of the opposed surface of said coin substantially different from the light reflectivity of said provided surface, preventing said conditioning of said machine for a subsequent gaming operation upon detecting said light reflectivity of the opposed surface of said coin substantially different from the light reflectivity of said provided surface, making a slot of a width less than the thickness parameter of a coin intended for said machine in the bottom wall of said coin track between said provided surface and said one side wall whereby an imitation of said coin with a thickness parameter less than the thickness parameter of a coin intended for said machine is guided by said provided surface to at least partially enter said provided slot, detecting any entrance of an imitation of said coin into said provided slot, and preventing said conditioning of said machine for a subsequent gaming operation upon detecting any entrance of an imitation of said coin into said provided slot.

* * * * *